United States Patent [19]

Mabuchi

[11] 3,996,929

[45] Dec. 14, 1976

[54] MASSAGING MACHINE

[75] Inventor: Kenichi Mabuchi, Tokyo, Japan

[73] Assignee: Mabuchi Motor Co., Ltd., Tokyo, Japan

[22] Filed: Nov. 19, 1975

[21] Appl. No.: 633,220

[30] Foreign Application Priority Data

| | | |
|---|---|---|
| Nov. 30, 1974 | Japan | 49-138221 |
| Jan. 28, 1975 | Japan | 50-12120 |
| Jan. 28, 1975 | Japan | 50-13286[U] |
| Jan. 28, 1975 | Japan | 50-13287[U] |
| Feb. 27, 1975 | Japan | 50-27109[U] |
| Mar. 15, 1975 | Japan | 50-34920[U] |
| Mar. 26, 1975 | Japan | 50-40497[U] |

[52] U.S. Cl. ..... 128/58; 128/36

[51] Int. Cl.[2] ..... A61H 11/00

[58] Field of Search ..... 128/36, 44, 48–53, 128/57, 58, 63, 32

[56] References Cited

UNITED STATES PATENTS

| | | | |
|---|---|---|---|
| 2,384,427 | 9/1945 | Andis | 128/57 |
| 2,688,960 | 9/1954 | Fischer et al. | 128/36 |
| 2,944,543 | 7/1960 | Newcombe | 128/32 |
| 3,023,749 | 3/1962 | Baume | 128/57 |

*Primary Examiner*—Lawrence W. Trapp

[57] ABSTRACT

A massaging machine formed as a mobile vehicle comprising a driving gear wheel for moving the vehicle by meshing with a flexible rack track belt which passes through the vehicle body and is held in tension, an electric motor for driving said gear wheel forward and backward, control levers provided on the front and rear ends of the vehicle body, changeover switches operated by said control levers, and a rotatable eccentric dead weight driven by the rotation of said driving gear wheel, in an arrangement that said vehicle is capable of automatically travelling forward and backward on said rack-track belt while vibrating itself during the travel.

12 Claims, 21 Drawing Figures

MASSAGING MACHINE

BACKGROUND OF THE INVENTION

1. Field of the Invention

This invention relates to massaging machine, and specifically to a massaging machine formed as a mobile vehicle and comprising a driving gear wheel for moving said vehicle by meshing with a flexible rack-track belt which passes through the vehicle body and is held in tension and also a rotatable eccentric dead weight which responds to the rotation of said driving gear wheel in an arrangement that said vehicle is capable of automatically travelling forward and backward over an ailing part of the patient's body.

2. Descripiton of the prior art

Generally, massaging treatment of tired muscles on the back or waist or other parts of the body by using a motor driven massaging machine requires the user of the machine to place it by himself on the part to be treated, often forcing him to take a very unnatural attitude particularly when massaging his back or waist. This is very inconvenient and a new massaging device involving no such inconvenience is desirable.

SUMMARY OF THE INVENTION

A general object of the present invention is to provide a massaging machine which can solve the above problem.

Another object of this invention is to provide a massaging machine formed as a mobile vehicle which, while vibrating itself, automatically travels forward and backward on a rack-track belt held by the vehicle in tension and stretched around the user's body so as to travel over the part to be massaged.

A further object of the present invention is to provide a massaging machine, wherein an eccentric dead weight for giving said vehicle vibration is so positionally disposed that it is prevented from making undesirable movements or generating vibrations that may shorten the service life of the massaging machine.

A still further object of the present invention is to provide a massaging machine constructed for easy attachment and detachment of said rack-track belt to or from said vehicle.

A still further object of this invention is to provide a massaging machine of which the surface of contact with the user's body can be adjusted as desired according to the shape of his body and also to the part to be massaged.

A still further object of this invention is to provide a massaging machine capable of properly selecting the extent and distance of the forward and backward travel of said vehicle.

A still further object of this invention is to provide a massaging machine which enables said vehicle not only to travel forward and backward but also to stay as desired on a part to be treated and to administer local massaging on such part.

BRIEF DESCRIPTION OF THE DRAWINGS

FIG. 1 is a perspective view of a track travelling mobile vehicle less its outer case and partly cut away; FIG. 2 is a side view of the vehicle in FIG. 1 partly cut away; FIG. 3 is an illustration showing how a control lever acts to turn a changeover switch; FIG. 4 is an illustration of electric circuit controlling the above mobile vehicle; FIG. 5 is an embodiment showing how to use a massaging machine of this invention; FIG. 6 and FIG. 7 show by way of example how to insert a rack-track belt into the track travelling mobile vehicle; FIG. 8 is a side view showing the action of rolling wheels of a massaging machine of this invention; FIG. 9 is a perspective view of the rolling wheels in FIG. 8; FIG. 10 illustrates the way the rolling wheels rotate; FIG. 11 is a perspective view of the rolling wheel; FIG. 12 and FIG. 13 are side views of rolling wheels partly in section, with the section illustrating the action of an adjust pin; and FIG. 14 shows how to attach a stopper to the rack-track belt and how to detach the stopper.

FIG. 15 show how to use the massaging machine; FIG. 16 is a perspective view of the interior of the track travelling mobile vehicle of the massaging machine; FIG. 17 is a perspective view of the opposite side of the mobile vehicle is FIG. 16; FIG. 18 is a partly cut away side view of the track travelling mobile vehicle; FIG. 19 illustrates the way the rack-track belt is pulled in and passes through the mobile vehicle; FIG. 20 is an embodiment in which its clutch is in engagement; and FIG. 21 shows the clutch in disengagement.

DETAILED DESCRIPTION OF PREFERRED EMBODIMENTS

Figure 1:
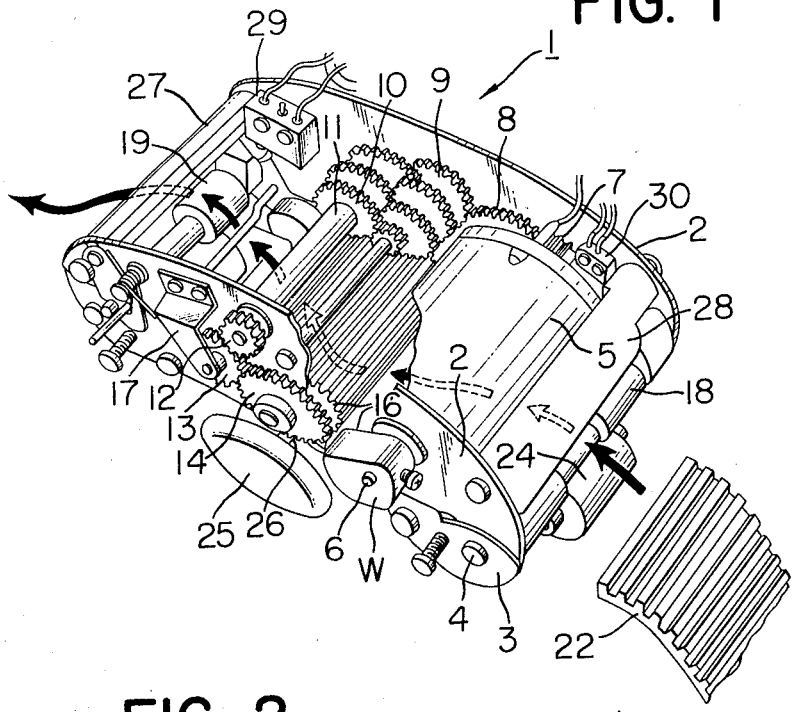
FIG. 1 through FIG. 14 show a massaging machine as an embodiment of this invention.

In FIG. 1, the outer case (not illustrated) of the track travelling mobile vehicle is provided with a pair of upper frames 2, 2, one on the right side of the case and the other on the left side. As will be described later with reference to FIG. 6 and FIG. 7, a pair of lower frames 3, 3 are provided against the pair of upper frames 2, 2 in a manner that each lower frame 3 can open by turning on a pin 4. Between the upper frames 2, 2 is provided a reversible DC motor 5 fixed to the upper frames 2, 2. (The type of the motor of course is not limited to a DC motor.) A pinion gear 7 is mounted on the drive shaft 6 of the motor 5, and the rotation of the pinion gear 7 is transmitted through a gear 8 meshing with the pinion gear 7 to a reducing gear train 9. The final stage gear 10 of the gear train 9 is mounted on a gear shaft 11 to rotate a transmission gear 12 on the outer side of the frame 2 which in turn rotates a gear 14 via a gear 13. The gear 14 is mounted on a shaft 15 which is rotationally supported by the upper frames 2, 2, and between the upper frames 2, 2 a driving wheel 16 is mounted on a shaft 15, so that the rotation of the gear 14 is directly passed on to the driving wheel 16 to rotate it. A bearing arm 17 rotationally supports the shaft of the gear 13. An eccentric dead weight (W) is mounted on the drive shaft 6 of the motor 5 to vibrate the entire body of the vehicle 1 by its eccentric rotation responding to the rotation of the motor 5.

A belt roller 18 is rotationally supported between the upper frames 2, 2 and another belt roller 19 also is supported rotationally between the lower frames 3, 3. These rollers serve to smoothen the movement of a rack-track belt 22 as will be described later with reference to FIG. 2. The above mentioned pin 4 also serves as the shaft of the belt roller 18.

Figure 2:
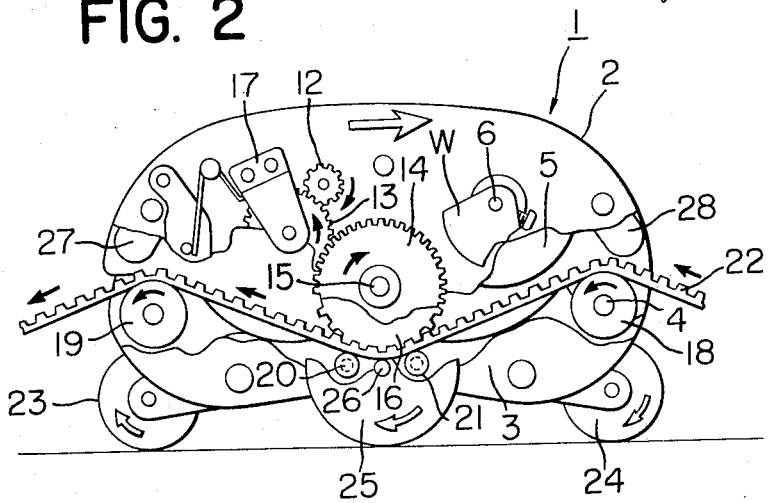

As it is clearly seen in FIG. 2, the lower frames 3, 3 rotationally support a rolling wheel 23, a rolling wheel 24, and also a pair of freewheels 25, and the freewheels 25 rotate freely on their shaft 26. The above roller wheels 23 and 24 serve as rollers rolling over the part to be massaged. The roller wheels 23 and 24 and the free wheel 25 work together as vibrators administering vibration to the part to be massaged.

Control levers 27 and 28 are installed, respectively, at the front end and the rear end of the vehicle 1 to be rotational relative to the upper frames 2, 2. A first changeover switch 29 fitted to one of the upper frames 2, 2 faces the control lever 27 and a second changeover switch 30 fitted to the upper frame 2 faces the control lever 28 and, as will be explained in FIG. 3 and FIG. 4, these switches 29 and 30 control the forward and backward rotation of the motor 5.

The rack-track belt 22 is fitted into and tunnels through the vehicle 1, as shown with arrows in FIG. 1, and by meshing with the driving wheel 16, moves the vehicle 1 when the motor 5 rotates the driving wheel 16.

Figure 20:
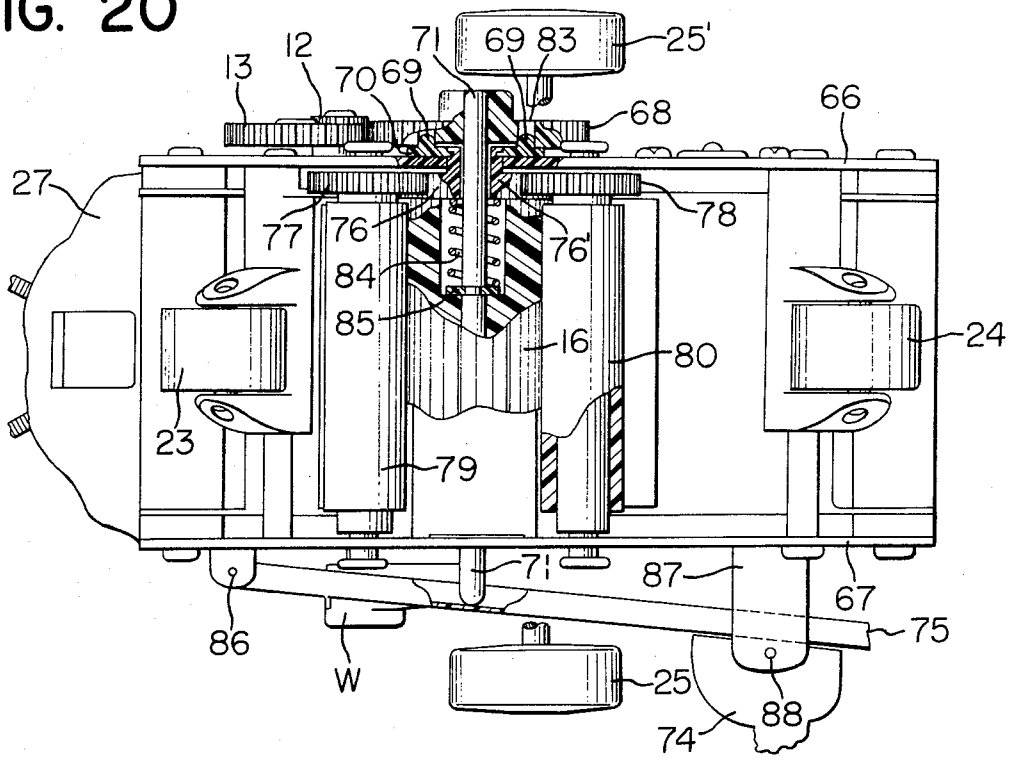
Figure 21:
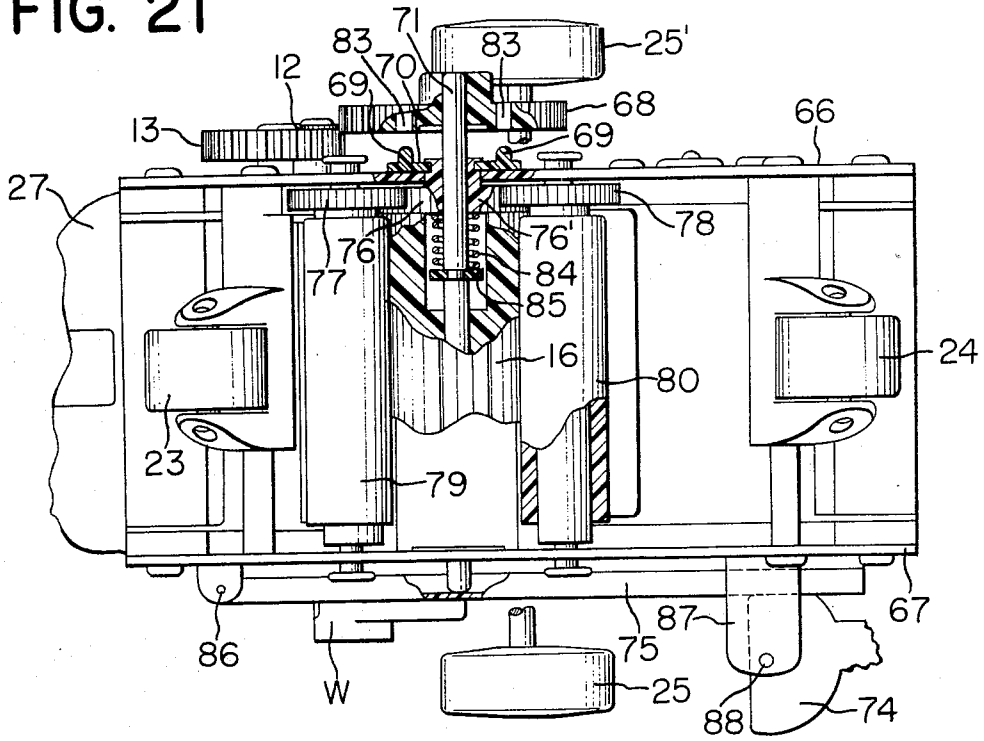

FIG. 2 is a partly cut away side view of the track travelling mobile vehicle 1 fitted with the rack-track belt 22. In FIG. 2, 20 and 21 are guide rollers for pushing the rack-track belt 22, being meshed with the driving wheel 16, against the driving wheel 16, and other symbols correspond to those in FIG. 1.

Now, with the rack-track belt 22 held in tension, if the motor 5 rotates and the driving wheel 16 rotates in the direction shown by an arrow in FIG. 2, the driving wheel 16 which is in mesh with the rack-track belt 22 rotates on the rack-track belt 22 causing the mobile vehicle 1 to move in the direction shown by a white arrow and the roller wheels 23 and 24 and the free-wheel 25 to rotate in the direction shown by three white arrows. At this time the rack-track belt 22 moves relative to the vehicle 1 in the direction shown by black arrows and belt rollers 18 and 19 will rotate in the direction shown by black arrows.

Figure 3:
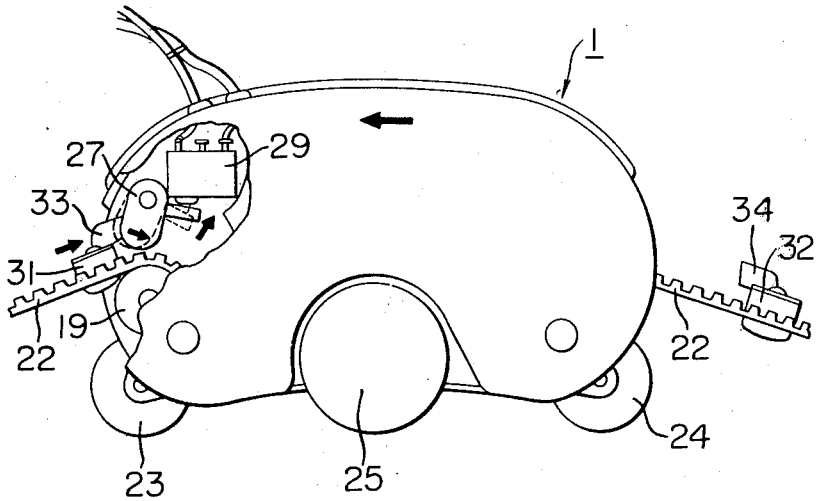

FIG. 3 is a partly cut away side view illustrating the relation between the control lever 27 and the first changeover switch 29 which controls the forward and backward movements of the track travelling vehicle 1.

In FIG. 3, stoppers 31 and 32 respectively provided with bumping pawls 33 and 34 are detachably fitted on the rack-track belt 22. Supposing that the body of the mobile vehicle 1 has moved in the leftward direction as shown by the arrow in FIG. 2 and reached the position of the stopper 31, the control lever 27 is now in contact with the bumping pawl 33 of the stopper 31; therefore, if the vehicle 1 in this position tries to continue its leftward movement, the control lever 27 will be turned in the direction shown by the arrow to the changeover switch 29 which, in turn, will reverse the rotation of the DC motor 5 on the vehicle 1 as will be explained later by referring to FIG. 4. The mobile vehicle 1 thus will start to move in the rightward direction this time. When the continued rightward movement has brought the vehicle 1 to the position of the stopper 32, the bumping pawl 34 of the stopper 32 will push another control lever 28 shown in FIG. 1 and FIG. 2 forcing it to operate the second changeover switch 30 which, in turn, reverse the rotation of the DC motor 5 on the vehicle 1 and the travelling vehicle 1 will start to move in the leftward direction again. In this way, the mobile vehicle shuttles between stoppers 31 and 32, and the distance of this shuttling movement may be selected as desired by selecting the positions on which the stoppers 31 and 32 will be fitted.

Figure 4:
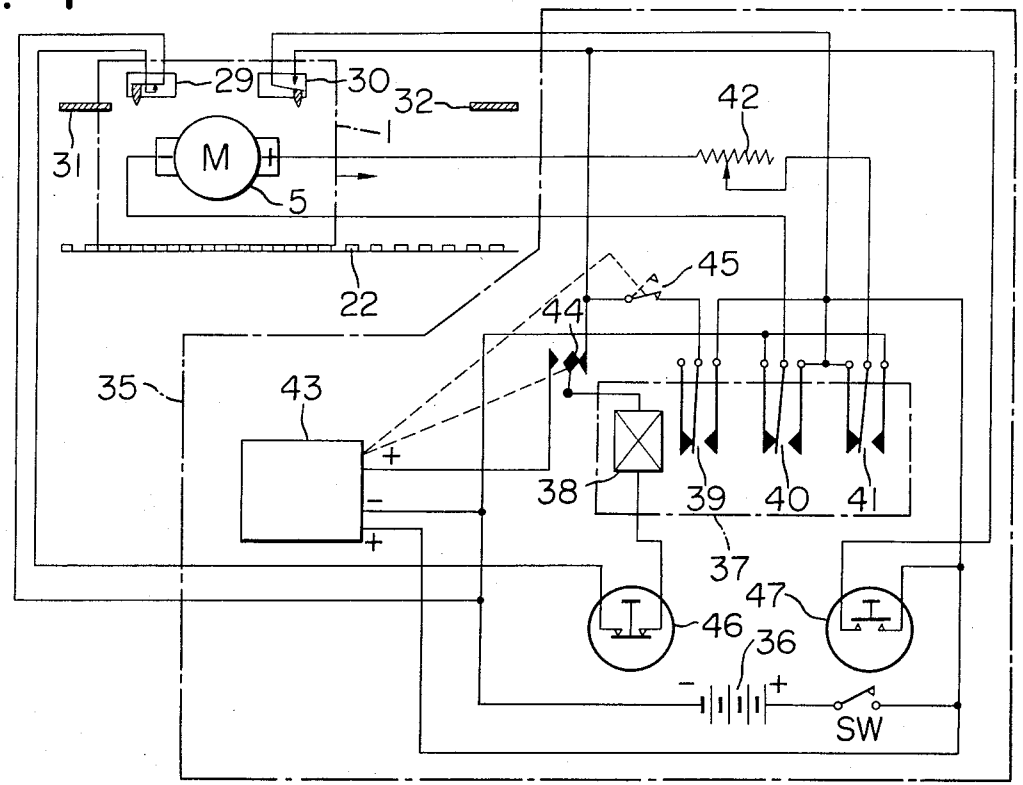

FIG. 4 is an embodiment of electric circuit for driving the mobile vehicle 1. In FIG. 4, symbols 1, 5, 22, 29, 30, 31, and 32 correspond to those in FIG. 1 through FIG. 3, and 35 is an electric control unit, 36 is a DC power source, (SW) is a power switch, 37 is a relay, 38 is a relay coil, and 39, 40, and 41 are relay contacts, 42 is a rheostat, 43 is a timer circuit which may be attached as necessary, 44 and 45 are contacts which will be operated by the timer circuit 43, 46 is a normal-OFF pushbutton switch which when depressed will close the circuit and 47 is a normal-ON pushbutton switch which when depressed will open the circuit.

Suppose that the mobile vehicle 1 is now moving in the direction shown by the arrow and the movement is not controlled by the timer 43.

Under this condition, the changeover switch 29 is in ON state, the changeover switch 30 is in OFF state, and the relay coil 38 is not energized, and relay contacts 39, 40, and 41 are all closed on the left side as shown in the drawing.

At this time the motor 5 is driven on the circuit from the DC power source 36 to the power switch (SW) to the relay contact 41 to the rheostat 42 to the motor 5 to the relay contact 40 to the DC power source 36, thereby moving the mobile vehicle 1 in the direction shown by the arrow. When the vehicle 1 reaches the position of the stopper 32, the changeover switch 30 is temporarily turned to ON and causes the relay coil 38 to be energized on the circuit from the DC power source 36 to the power switch (SW) to the changeover switch 30 to the contact 44 to the relay coil 38 to the normal-ON pushbutton switch 46 to the changeover switch 29 to the DC power source 36, and attracted by the energized relay coil 38, the relay contacts 39, 40, and 41 close on the right side, and with the relay contact 39 closed on the right side, the relay coil 38 becomes self-holding. Under this condition, the motor 5 now rotates in reverse direction on the circuit from the DC power source 36 to the power switch (SW) to the relay contact 40 to the motor 5 to the rheostat 42 to the relay contact 41 to the DC power source 36; i.e., the mobile vehicle 1 starts movement in the leftward direction. At this time the changeover switch 30 turns into OFF-state, but the self-holding of the relay coil 38 can maintain the above condition unchanged.

Then, as the mobile vehicle 1 moves leftward, the stopper 31 temporarily turns the changeover switch 29 to OFF to open the selfholding circuit of the relay coil 38 from the DC power source 36 to the power switch (SW) to the relay contact 39 to the contact 45 to the contact 44 to the relay coil 38 to the normal-ON pushbutton switch 46 to the changeover switch 29 to the DC power source 36. This deactivates the relay coil 38, and the relay contacts 39, 40 and 41 return to the state as shown in the drawing, so the rotation of the motor 5 is turned into the forward direction and the mobile vehicle 1 starts rightward movement. At this time the changeover switch 29 returns to ON state, but with the energizing circuit of the relay coil 33 open, the above condition is maintained as shown in the drawing.

The mobile vehicle 1 automatically moves forward and backward as described above. The directional changeover of this movement may also be effected before the mobile vehicle 1 arrives at the stopper 31 or 32, by operating the pushbutton 46 or 47. When the normal-ON pushbutton switch 46, which is inserted in series with the changeover switch 29, is temporarily depressed, the circuit operates in the same way as when the changeover switch 29 is operated. When the normal-OFF pushbutton 47, which is inserted in parallel with the changeover switch 47, is temporarily depressed, the operation is the same as when the change-over switch 30 is operated.

Further, the above pushbuttons 46 and 47 may also be operated automatically by the timer circuit 43. In this case, the timer circuit 43 switches the contact 44 alternately to the right and the left at regular intervals set by a dial or other means not illustrated, and activation and deactivation of the relay coil 38 are repeated in response to the switching. While the timer circuit 43 is at work, the contact 45 is maintained in OFF state. In this way, the mobile vehicle 1 repeats its forward and backward movements in accordance with the setting of the above time intervals.

Also, it is possible to change the moving speed of the mobile vehicle 1 by changing the resistance value of the rheostat 42.

Figure 5:
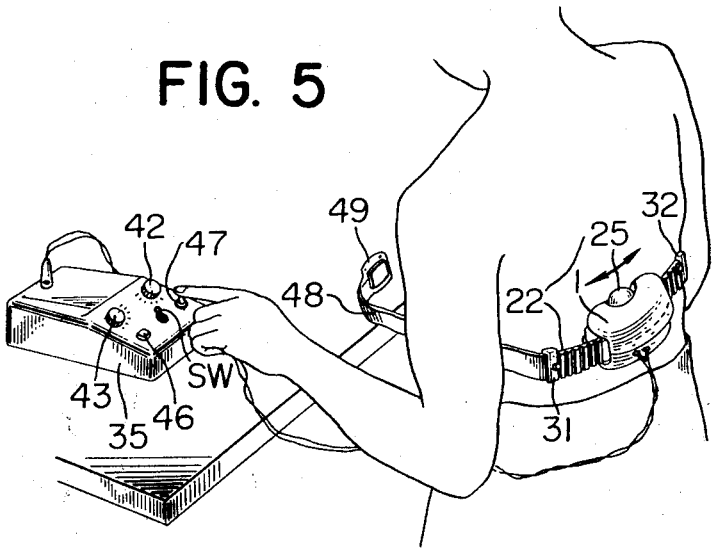

FIG. 5 shows a mode of usage of the massaging machine of this invention. In this case, it is needless to say that an eccentric dead weight (W), illustrated in FIG. 1 and FIG. 2, is mounted on the drive shaft 6 of the motor 5 so that the entire body of the mobile vehicle 1 vibrates responding to the rotation of the motor 5 while travelling forward and backward on the rack-track belt 22.

Symbols in FIG. 5 correspond to those in FIG. 1 through FIG. 4, and 48 is a belt to which the rack-track belt 22 is attached, and 49 is a belt buckle.

To massage the user's back, the mobile vehicle 1 is held by the belt 48 on the part to be treated and the range of the shuttling movement of the mobile vehicle 1 is set by stoppers 31 and 32. With the power switch (SW) is turned ON in this condition, the mobile vehicle 1 travels forward and backward between the stoppers 31 and 32 as has been explained with reference to FIG. 4, and the eccentric dead weight (W) illustrated in FIG. 1 and FIG. 2 vibrates the entire body of the vehicle 1 during this travel. This vibration is transmitted to the freewheel 25 to massage the part to be treated. Needless to say, the range of shuttling movement can be controlled by selecting the positions of stoppers 31 and 32 and the localization of the movement is also possible by operating pushbuttons 46 and 47 or using the timer 43. For using the mobile vehicle 1 as a stationary vibrator for massaging only one part of the user's body, a clutch or similar means will be provided between the pinion gear 7 and the driving gear wheel 16, illustrated in FIG. 1, to cut off the power transmission, as will be explained later in FIG. 20 and FIG. 21 with the embodiment shown in FIG. 15 and subsequent drawings.

Figure 6:
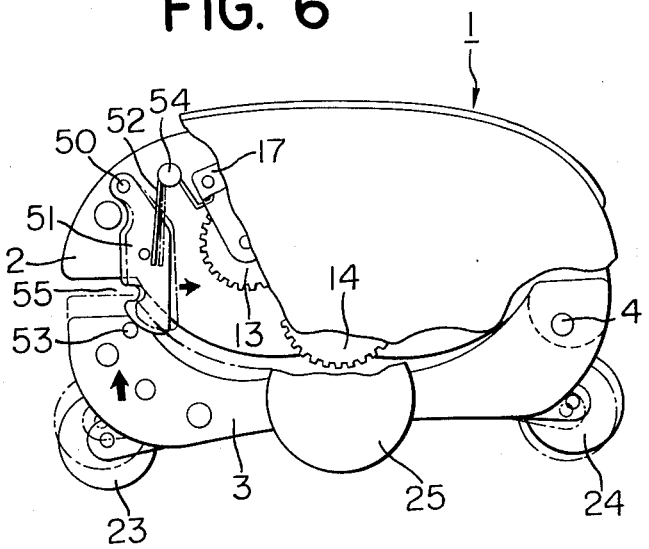
Figure 7:
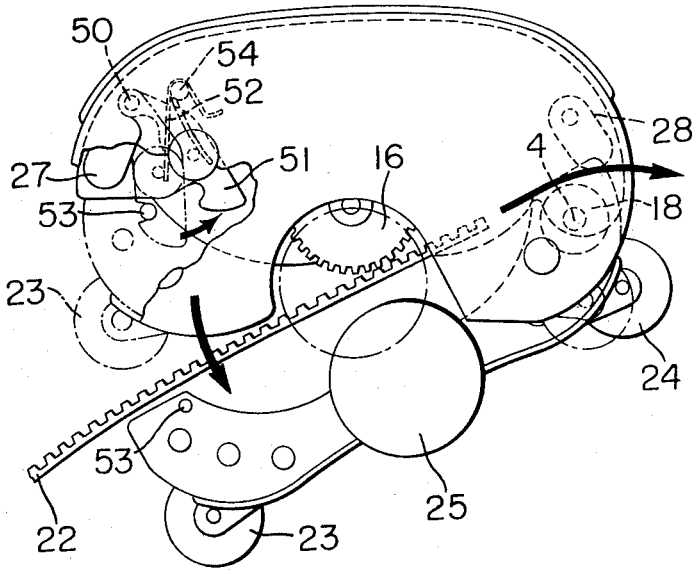

FIG. 6 and FIG. 7 illustrate the method of inserting the rack-track belt 22 into the mobile vehicle 1. A means of admitting the rack-track belt 22 into the mobile vehicle, referred to as an opening means in this invention, is provided, comprising a hook plate 51 rotationally supported on a hook plate shaft 50 at the opening end of the upper frame 2, said hook plate shaft 50, a latch pin 53, a spring 52, and also the pin 4, as shown in FIG. 6. When the hook plate 51 is rotated rightward resisting the spring 52 which pushes the hookplate 51 in the leftward direction in the drawing, the latch pin 53 will disengage from the notch 55 of the hook plate 51 allowing the lower frames 3, 3 to open by turning downward on the pin 4. As shown in the drawing, the spring 52 is fixed to the upper frame 2 by a shaft 54 and the latch pin 53 is fixed to the lower frame 3.

Then, as shown in FIG. 7 advance the rack-track belt 22 along the opened surface between the right side and left side lower frames 3, 3 and over the guide rollers 20 and 21 (See FIG. 2.) supported by the lower frames 3, 3, and the rack-track belt will be positioned under the driving wheel 16 supported by the upper frames 2, 2 to be held between the driving wheel 16 and the guide rollers 20 and 21. Then, pull out the right end of the rack-track belt 22 from between the belt roller 18 and the control lever 28, close the opening end latch the latch pin 53 onto the notch 55 of the hook plate 51. As the hook plate 51 is pushed to the left by the spring 52, the upper frames 2, 2 and the lower frames 3, 3 are now closed tightly together and the rack-track belt 22 is now free to slide for meshing with the driving wheel 16. In this way, the rack-track belt 22 is installed and movably held between the driving wheel 16 and guide rollers 20 and 21 as shown in FIG. 2.

FIG. 8 through FIG. 13 illustrate the method of adjusting rolling wheels 23 and 24 in order to become fitting to the part to be massaged.

Figure 8:
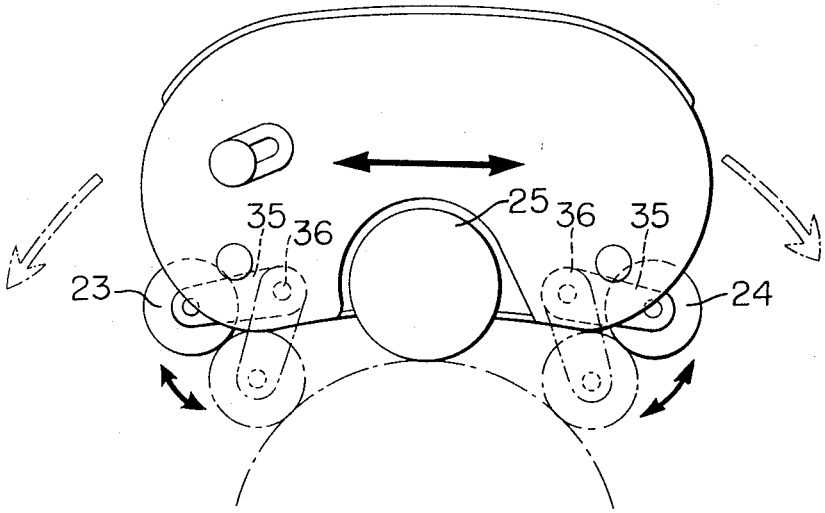
Figure 9:
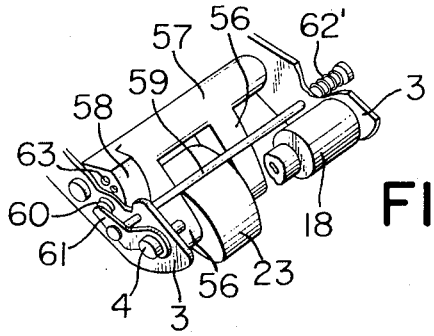
Figure 10:
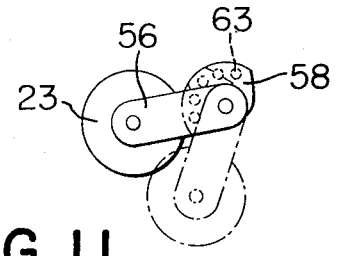
Figure 11:
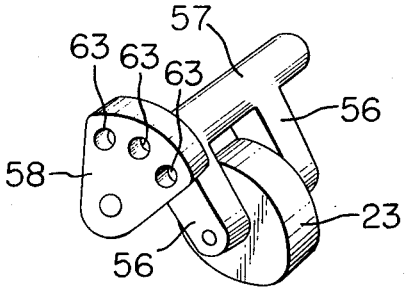
Figure 12:
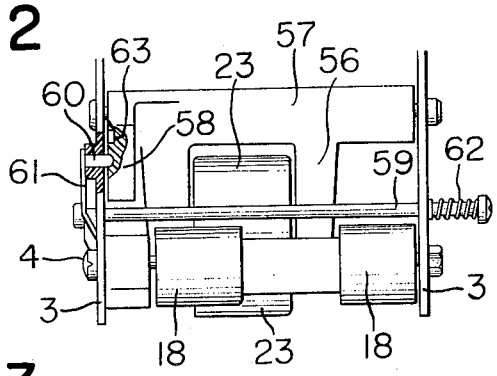
Figure 13:
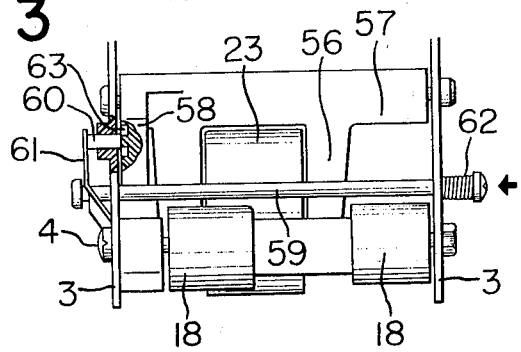

As shown in FIG. 9, a pair of supporting arms 56, 56 rotationally support the rolling wheel 23 and the supporting arms 56 are fastened to a rotational shaft 47 and one end of the rotational shaft 57 forms an angle adjusting plate 58. The rotational shaft 57 is rotationally mounted to lower frames 3, 3. An adjust pin working shaft 59 runs through the lower frames 3, 3 and on its one end is mounted an elastic adjust strip 61 having an adjust pin 60 at the tip, as shown in FIG. 12 and FIG. 13, and one end of the elastic adjust strip 61 is fastened to the lower frame 3. A spring 62 is provided to the other end of the operating shaft 59, which exerts pressure on the elastic adjust strip 61 at the opposite end of the shaft 59 in the direction to the lower frame 3. Utilizing this spring action, the adjust pin 60 at the tip of the elastic adjust strip 61 is inserted through the lower frame 3 into one of the two or more holes 63 of the angle adjusting plate 58 to set the angle adusting plate 58 at a selected angle, and in this way the rolling wheel 23 is also set at this selected angle in order to become fitting to the part to be massaged. FIG. 10 illustrates how to shift the rolling wheel 23. By withdrawing the adjust pin 60 from the hole 63 and inserting it into another hole 63 which corresponds to the position indicated by broken line, the angle adjust plate 58 can change its angle, and multiple-stage angle adjustment is possible by providing a plural number of holes 63 on the angle adjust plate 58. Through this arrangement, the straight line formed by the rolling wheels 23 and 24 and the freewheel 25 as shown in FIG. 8 may be displaced to obtain a curvature suitable for the parr to be massaged. FIG. 11 illustrates the relationship between the rolling wheel 23, the angle adjust plate 58, the rotational shaft 57, and the supporting arms 56, 56.

FIG. 12 and FIG. 13 illustrates the action of the adjust pin 60. As shown in FIG. 12, the working shaft 59, being acted on by the spring 62, sets the adjust pin 60 of the elastic adjust strip 61 into the selected one of the holes 63 resisting the elastic force of said elastic strip 61. To change the angle of the rolling wheel 23, push the working shaft 59 counter to the force of the spring 62 as shown by an arrow in FIG. 13, and the restoring force of the elastic adjust strip 61 will withdraw the adjust pin 60 from the hole 63 and the angle adjust plate 58 will become rotational. Then, shift the rolling wheel 23 into proper contact with the part to be massaged and release the working shaft 59, and the spring 62 will pull the elastic adjust strip 61 toward the lower frame 3 and the adjust pin 60 will be inserted into a new hole 63 to fix the angle adjusting plate 58, thereby setting the position of the rolling wheel 23 in close contact with the part to be massaged. The setting of the rolling wheel 24 is also accomplished in the same way as above.

In this way, the rolling wheels 23 and 24 can change their angles to become fitting to the part to be massaged, as the curvature of the part to be massaged may vary with individual users and locations on the body, and the movement of the mobile vehicle 1 is thus adaptable to the curvature of the part to be massaged.

Figure 14:
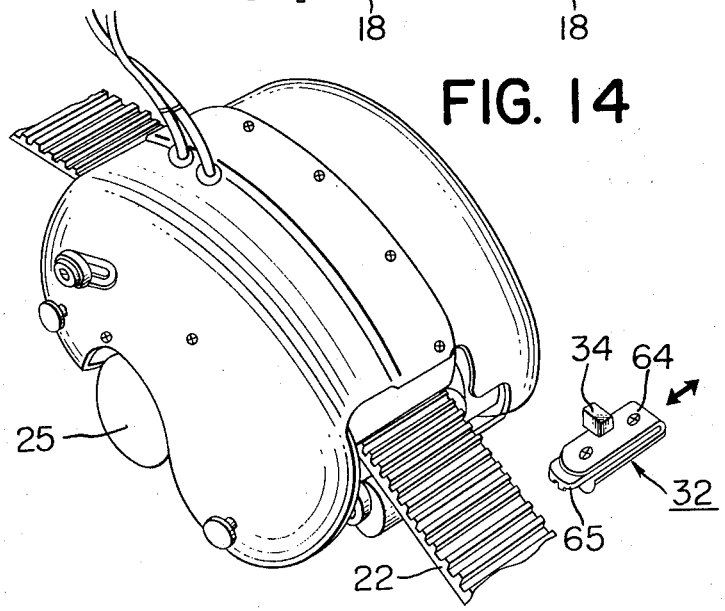

FIG. 14 illustrates the construction of stoppers 31 and 32 and how to fit them onto the rack-track belt 22.

Stoppers 31 and 32 are positioned on the rack-track belt 22 spaced from each other to have the mobile vehicle 1 is between them. The inside surface of a clip-shaped body 64 has teeth 65 for meshing with the rack-track belt 22. Fit the open end of the clip-shaped body 64 to the side edge of the rack-track belt 22 and advance it across the rack-track belt 22; and the stopper 32 is set to the rack-track belt 22 with the teeth 65 in mesh with the rack-track. The clip-shaped body 64 has on its upper side a bumper pawl 34 for turning control levers 27, 28 as shown in FIG. 1. To detach the stopper 31 from the rack-track belt 22, reverse the above described setting procedure. The construction of the other stopper 32 is the same as that of the stopper 31.

FIG. 15 through FIG. 21 show another massaging machine as another embodiment of this invention.

Figure 15:
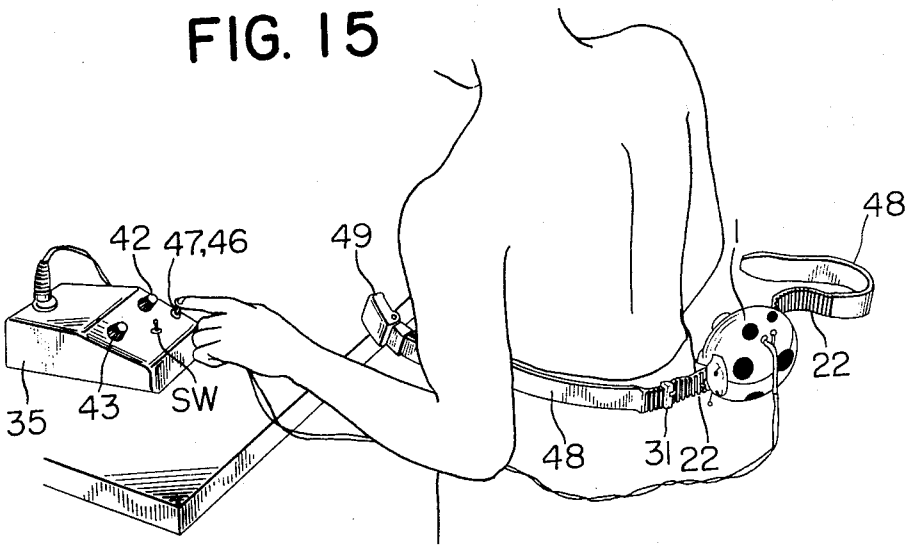
FIG. 15 through FIG. 21 show another massaging machine as another embodiment of this invention.

FIG. 15 shows the way this massaging machine is in use. This machine is also used in the same way as with the massaging machine illustrated in FIG. 1 through FIG. 14.

Figure 16:
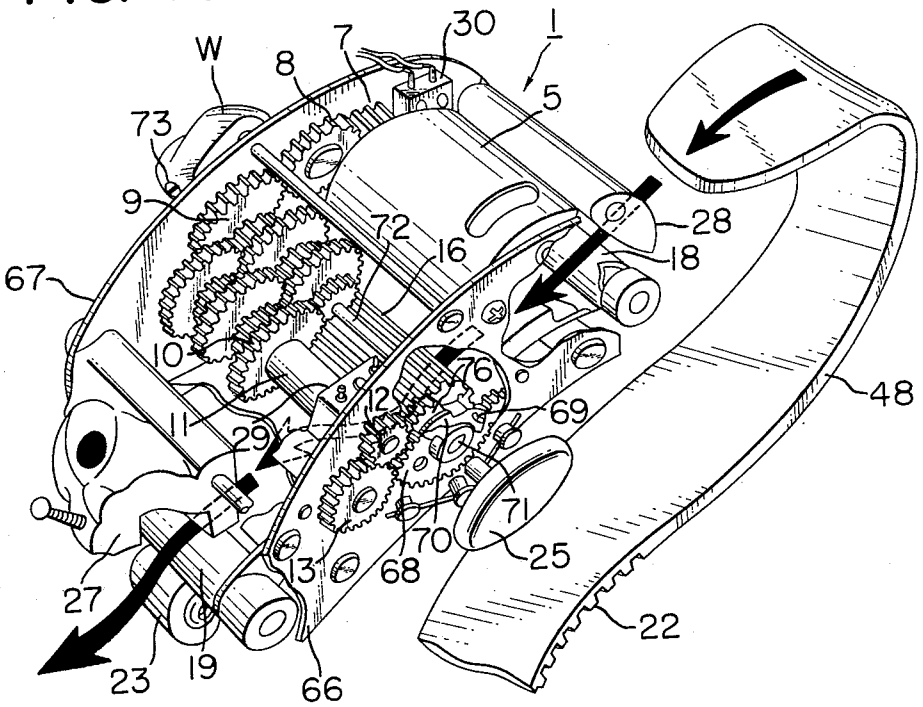

In FIG. 16, right and left side plates 66 and 67 are provided in the track travelling mobile vehicle 1 and a motor 5 is fixedly installed between the side plates 66 and 67. The rotation of the motor 5 is transmitted to a driving wheel 16 by a group of gears comprising: a pinion gear 7; a spur gear 8 mounted to the right side plate 67; a reducing gear train consisting of a gear set 9 on a shaft 72 and a gear set 10 on a shaft 11; a pinion gear 12 outside the left side plate 66 and driven by a shaft 11; spur gear 13 is mesh with the pinion gear 12; and a clutch spur gear 68 in mesh with the spur gear 13 and connected to the driving wheel 16 by clutch pins 69 and a clutch plate 70. The driving wheel 16 is disposed to mesh with a flexible rack-track belt 22 inserted as shown by a large arrow in FIG. 16 and set as shown in FIG. 17 in the mobile vehicle 1.

Figure 17:
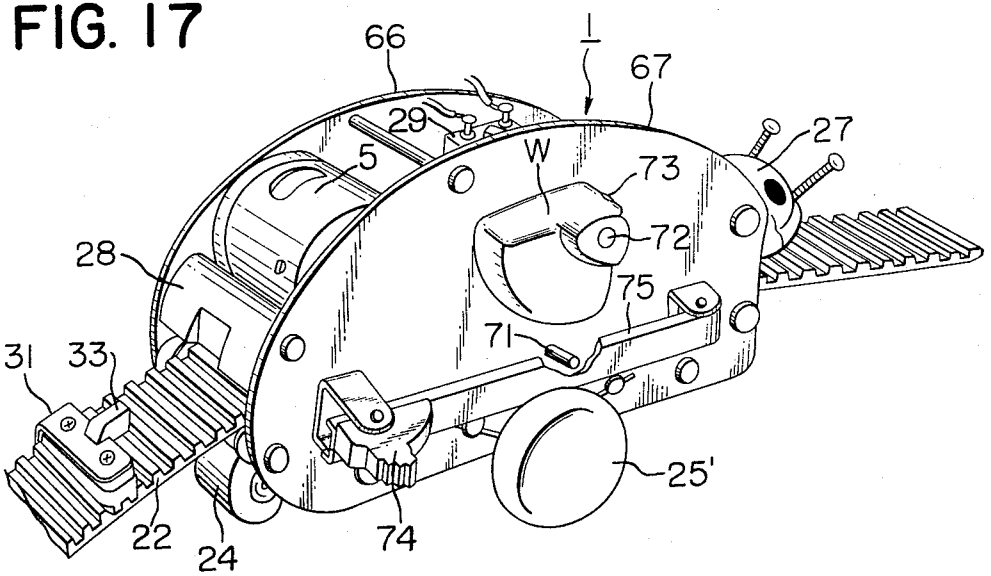
Figure 18:
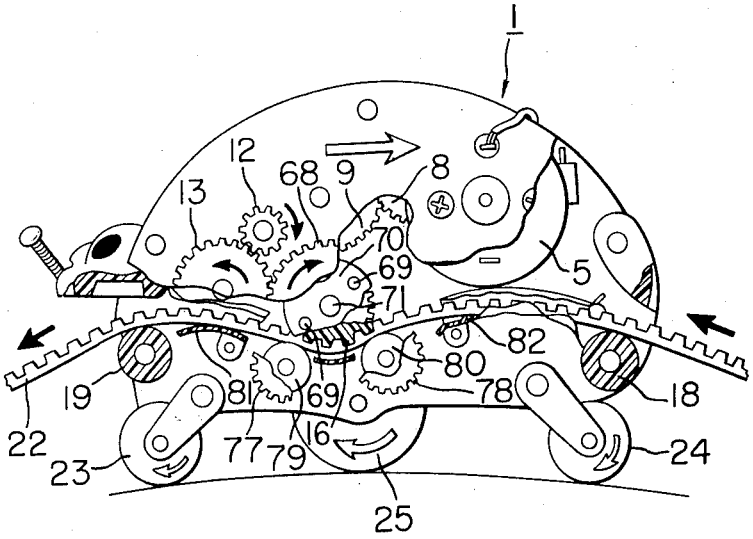

Outside the right side plate 67, an eccentric dead weight (W) is rotationally mounted by a pin 73 on one of the above power transmission shafts, for example the shaft 72, as shown in FIG. 17 and FIG. 18; so, as the motor 5 rotates, the eccentric dead weight (W) is driven into rotation and vibrates the entire body of the mobile vehicle 1 to massage the affected part with the right and left main rolling wheels 25, 25′ (in FIG. 17) and front and rear vibrating rollers 23 and 24. As the eccentric dead weight (W) is rotationally supported on the shaft 72, the drive shaft bearing of the motor 5 is prevented from the heavy impact accompanying the vibration of the dead weight (W).

At the front end and the rear end of the mobile vehicle 1 are installed control levers 27 and 28 and they are rotational relative to the side plates 66 and 67. In the same way as with the embodiment illustrated in FIG. 1 through FIG. 14, they are rotated by stoppers 31 and 32 fitted on the rack-track belt 22 and operate change-over switches 29 and 30 in order to control the forward and backward rotation of the motor 5.

As shown in FIG. 17, a clutch knob 74 and a clutch lever 75 are provided outside the right side plate 67, and a revolving shaft 71, running through the center of the clutch plate 70 (FIG. 16) and the driving wheel 16 (FIG. 16), protrudes outside the right side plate 67. As will be explained later with FIG. 20 and FIG. 21, when the clutch knob 74 is turned selfward by 90° from the state shown in FIG. 17, the protruded shaft 71 will be pushed in by the clutch lever 75. This will push out the clutch spur gear 68 shown in FIG. 16 in the selfward direction in FIG. 16 and disengage the clutch spur gear 68 from the clutch pins 69 on the clutch plate 70 causing the driving wheel 16 to stop driving although the motor 5 continues running. In other words, the mobile vehicle 1 ceases to move forward and backward and becomes a stationary vibrator.

FIG. 18 is a partly cut away side view illustrating the setting of the rack-track belt 22 in the track travelling mobile vehicle 1.

Figure 19:
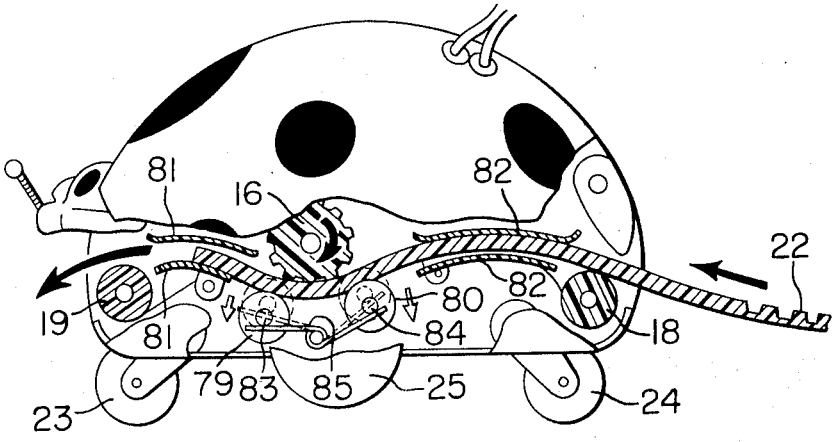

In FIG. 18, a transmission gear 76 (FIG. 16) for roller rotation, which is coupled to the clutch plate shaft 76′ and rotates integrally with the driving wheel 16, is provided on the opposite side of the clutch plate 70, and a front roller gear 77 and a rear roller gear 78 are provided to mesh with the transmission gear 76. A front press roller 79 is rotated by the gear 77 and a rear press roller 80 is rotated by the gear 80. As shown in FIG. 18 and FIG. 19, the roller 79 and 80 push up from below the rack-track belt against the driving wheel 16 and rotate in agreement with the rotation of the driving wheel 16 to smoothen the movement of the rack-track belt.

FIG. 19 illustrates how to pass the rack-track belt 22 through the mobile vehicle 1. Guides 81 and 82 for guiding the rack-track belt 22 are provided in the mobile vehicle 1 and rollers 18 and 19 are also provided on the path formed by the guides 81 and 82. Also, a shaft 83 of the front press roller 79 and a shaft 84 of the rear press roller 80 are elastically supported by springs 85, 85.

As shown in FIG. 19, insert one end of the rack-track belt 22 to ride over either the roller 18 or the roller 19 — in this case, over the roller 18 by way of example — and the end of the belt 22 will follow the guide 82 and reach the narrow opening between the driving wheel 16 and the rear press roller 80. When the driving wheel 16 is rotated by the motor 5 with the end of the rack-track belt 22 in this position, the belt end will mesh with the driving wheel 16 and will be pulled in and follow the guide 81 to reach the front roller 19. Then, if the motor 5 continues to rotate the driving wheel 16, it will continue to pull in the rack-track belt 22 automatically. For quicker setting of the rack-track belt 22, use the above described clutch spur gear 68 to disengage the motor 5 from the driving wheel 16, and then pull out the end of the rack-track belt 22 by hand. In this case, the rack-track belt 22 is readily pulled out because the driving wheel 16 is now in a freewheeling condition.

FIG. 20 illustrates a clutching mechanism of this invention in the engaged condition and FIG. 21 illustrates the clutch in the disengaged condition.

As shown in FIG. 20 and FIG. 21, the rotating shaft 71 of the clutch spur gear 68 runs through the center of the driving wheel 16 and protrudes on the outside of the right side plate 67, and the clutch spur gear 68 has pin insertion holes 83, 83 for accepting clutch pins 69, 69. When the shaft 71 is pushed in the downward direction in FIG. 20 by the coil spring 84 and the spring stopper 85, clutch pins 69, 69 of the clutch plate 70 engage with the pin insertion holes 83, 83 bringing the clutch spur gear 68 into meshed contact with the spur gear 13, and when these gears are driven into rotation, the clutch plate 70 is also driven into rotation to rotate the driving wheel 16.

The clutch lever 75 outside the right side plate 67 is supported on one end by a pin 86 and in the normal condition, i.e., when the clutch is in engagement, the shaft 71, pushed by the coil spring 84, pushes the clutch lever 75 outside the right side plate 67. Toward the other end of the clutch lever 75 a clutch-knob mounting frame 87 is provided, and a clutch knob 74 is mounted on a clutch-knob shaft 88 fitted to said frame 87. The clutch knob 74 is rotational on the clutch-knob shaft 88 and, when the clutch knob 74 is rotated 90° as shown in FIG. 21, a side edge of the clutch knob 74 pushed the clutch lever 75 which, in turn, pushes up the shaft 71 of the clutch spur gear 68 as shown in FIG. 21 to disengage the pin insertion holes 83, 83 of the clutch spur gear 68 from the clutch pins 69, 69 of the clutch plate 70, thereby effecting the disengagement of the clutch. Therefore, by bringing the clutch knob 74 into this condition shown in FIG. 21, the rotation of the clutch spur gear 68 is cut off from the side of the driving wheel 16 and now the mobile vehicle 1 does not travel on the rack-track belt 22 and vibrates staying where it is.

What is claimed is:

1. A massaging machine, comprising:

a driving wheel for driving the vehicle of said massaging machine by holding a rack-track belt stretched in tension and by meshing with said rack-track belt;

an electric motor for rotating said driving wheel forward and backward; and control levers provided to the front end and the rear end of said vehicle and also changeover switches respectively operated by said control levers;

in an arrangement that, when one of stoppers set on said rack-track belt acts on one of said control levers, said control lever operates one of said changeover switches to control electric current powering said electric motor causing said vehicle to travel on said rack-track belt.

2. A massaging machine in claim 1, wherein at least one of drive shafts between and including the drive shaft of said electric motor and the drive shaft of said driving wheel is mounted with an eccentric dead weight.

3. A massaging machine in claim 2, wherein said eccentric dead weight is mounted on the drive shaft of said electric motor.

4. A massaging machine in claim 3, wherein clutching mechanism is provided between said drive shaft of said electric motor and said drive shaft of said driving wheel.

5. A massaging machine in claim 2, wherein at least one drive shaft other than said electric motor drive shaft is mounted with said eccentric dead weight.

6. A massaging machine in claim 5, wherein clutching mechanism is provided between said electric motor drive shaft and said drive shaft of said driving wheel and at the same time said eccentric dead weight is mounted on at least one drive shaft between said clutching mechanism and said electric motor drive shaft.

7. A massaging machine in claim 6, wherein said clutching mechanism acts to transmit driving power to said driving wheel and also to release said driving wheel from said driving power.

8. A massaging machine in claim 1, wherein an upper pair and a lower pair of frames holding said rack-track belt are hinged on a shaft and movable to provide an opening.

9. A massaging machine in claim 1, wherein one or more rack-track belt guides are provided to the path of said rack-track belt through the body of said vehicle in an arrangement that said rack-track belt is guided by said guides to the surface of said driving wheel.

10. A massaging machine in claim 1, wherein press rollers are provided to push against said driving wheel said rack-track belt in mesh with said driving wheel and said press rollers are elastically supported.

11. A massaging machine in claim 1, wherein rolling wheels and supporting arms for supporting revolving shafts of said rolling wheels are provided under the front and rear ends of said vehicle and said supporting arms are rotational relative to said vehicle.

12. A massaging machine in claim 1, wherein each of said stoppers has a bumper pawl and also a clip for holding said rack-track belt so that each of said stoppers can be detachably attached to said rack-track belt.

* * * * *